US007588101B2

(12) United States Patent
Lynde et al.

(10) Patent No.: US 7,588,101 B2
(45) Date of Patent: Sep. 15, 2009

(54) RADIALLY EXPANDABLE DOWNHOLE FLUID JET CUTTING TOOL HAVING AN INFLATABLE MEMBER

(75) Inventors: Gerald D. Lynde, Houston, TX (US); Mary L. Laird, Madisonville, LA (US)

(73) Assignee: Baker Hughes Incorporated, Houston, TX (US)

( * ) Notice: Subject to any disclaimer, the term of this patent is extended or adjusted under 35 U.S.C. 154(b) by 3 days.

(21) Appl. No.: 12/154,781

(22) Filed: May 27, 2008

(65) Prior Publication Data

US 2008/0271892 A1 Nov. 6, 2008

Related U.S. Application Data

(63) Continuation-in-part of application No. 11/522,692, filed on Sep. 18, 2006, now Pat. No. 7,434,633.

(51) Int. Cl.
*E21B 43/11* (2006.01)

(52) U.S. Cl. ..... 175/67; 166/55.8; 175/424

(58) Field of Classification Search ..... 166/55.8, 166/222, 223; 175/67, 424
See application file for complete search history.

(56) References Cited

U.S. PATENT DOCUMENTS 2,271,005 A * 1/1942 Grebe ..... 175/61
5,402,855 A * 4/1995 Gondouin ..... 175/21
7,434,633 B2 * 10/2008 Lynde et al. ..... 175/67

* cited by examiner

*Primary Examiner*—William P Neuder
(74) *Attorney, Agent, or Firm*—Greenberg Traurig, LLP; Anthony F. Matheny

(57) ABSTRACT

Downhole fluid jet cutting tools having extendible and retractable arms with cutting heads on the ends are disclosed. The jet cutting tools permit casing and other downhole surfaces to be cut utilizing a cutting fluid forced through a jet nozzle assembly. Inflation of an inflatable member within the passageway of the tool moves the jet nozzle assembly when cutting fluid pressure inflates the inflatable member. As a result, a cutting head of the jet nozzle assembly is extended and cutting fluid is forced at high pressure from the passageway to the cutting head where it is expelled through nozzles for cutting casing and the like. The jet cutting tools permit the cutting head to be extended, retracted, and re-extended or redeployed multiple times without the need for being retrieved from the wellbore.

19 Claims, 9 Drawing Sheets

RADIALLY EXPANDABLE DOWNHOLE FLUID JET CUTTING TOOL HAVING AN INFLATABLE MEMBER

RELATED APPLICATION

This application is a continuation-in-part of, and claims priority to, U.S. patent application Ser. No. 11/522,692, filed Sep. 18, 2006, now U.S. Pat. No. 7,434,633.

BACKGROUND

1. Field of Invention

The present invention is directed to a downhole cutting tool and, in particular, a downhole radially expandable fluid jet cutting tool.

2. Description of Art

Various types of cleaning or cutting jet blasting arrangements have been proposed and used for jet blasting or eroding surfaces with abrasive fluids including, by way of example only, steam, water or any other fluid along with or without an abrasive substance in an attempt to accomplish whatever results may be desired.

Generally the fluids are conducted through a fluid passage in the arrangement and discharged through a restricted orifice in a jetting nozzle to increase the velocity of fluids and abrasive particles in an attempt to increase the cutting or cleaning effect desired. The jetting nozzle is available in a variety of designs and sizes and is normally produced from an extremely hard and/or tough material such as, by way of example only, carbide. It is generally accepted that the closer a jetting nozzle is to the surface to clean or cut the higher the efficiency of the operation.

One such prior jetting tool apparatus is disclosed in U.S. Pat. No. 5,765,756. The jetting tool apparatus of this patent includes multiple extendible telescoping jetting nozzles that are rotated into position by fluid flowing through the tool. In addition to rotation, the jetting nozzles extend telescopically so as to come in close contact with the cutting surface. After the cutting is completed, however, the nozzles remain extended. They are rotated downward into recesses to facilitate movement of the tool out of the wellbore. In those instances where the tool is to be moved to a new location for continued jetting, the telescopically extended jetting nozzles can not be reconfigured to a lesser extension because the telescoping members cannot be retracted to their original positions. As a result, the tool in U.S. Pat. No. 5,765,756 is limited in its use and requires removal of the tool from the well and resetting of the telescoping jetting nozzles before the tool can be used in a new, narrower, location. As is apparent, removal of the tool for resetting and subsequent repositioning in the well is time consuming and costly.

SUMMARY OF INVENTION

The present invention overcomes the deficiencies of U.S. Pat. No. 5,765,756 while providing additional benefits not found in prior jet cutting tools. For example, the jet cutting tools and methods of cutting a surface of a wellbore of the present invention provide the capability to extend and retract the jetting nozzles for easy and quick relocation and redeployment within a well without the need for removal of the tool from the well; permit the jetting nozzles to be consistently extended to the cutting surface; maintain the jetting nozzles in the appropriate orientation during cutting; permit easy and efficient cutting of casing when passing through a restriction in the casing or when cutting a surface in relatively shallow water depth; permit efficient cutting in multiple locations within conduits having variable inner diameters; and provide the capability of cutting in large diameter conduits and then be redeployed for cutting in small diameter conduits without having to remove the tool from the wellbore.

Broadly, the present invention is directed to a jet cutting tool having one or more arms that are extendable radially from the body of the tool. Each arm is in fluid communication with a passageway within the tool. An actuating member, such as a piston, is disposed within the passageway. Each arm includes a cutting head disposed on the end. The cutting head may include a metal cutting element such as crushed carbide or other carbide elements. Cutting fluid, such as an abrasive slurry known to persons skilled in the art, is pumped at high pressure down the passageway and moves the piston. The piston in turn extends each of the arms until each arm is in contact with the inner wall surface of the cutting surface or casing of the well. Cutting fluid is also forced into a length of tubing in fluid communication with the passageway and the cutting head. After extension of the arms to the point where the piston is no longer movable by the cutting fluid, the cutting head is positioned next to, and preferably in contact with, the cutting surface. The cutting fluid is then forced through the length of tubing from the passageway to the cutting head and out of the nozzle at a high pressure. The high pressure of the cutting fluid being expelled from the nozzle of the cutting head cuts the casing or other cutting surface.

After cutting, the pressure of the cutting fluid flowing through the passageway is decreased and the piston is retracted. Accordingly, the arms are also retracted so that the jet cutting tool can be moved to a new location and the arms redeployed for additional cutting. Advantageously, the retraction and the extension of the arms are fully repeatable such that the jet cutting tool can be used in multiple locations having multiple inner diameter, including cutting narrower portions of casing after cutting wider portions of casing.

In another embodiment, the actuating member is an inflatable. The inflatable is inflated by the cutting fluid. As a result, the inflatable moves the arm outwardly so that the casing or other cutting surface can be cut similarly to the embodiment discussed above. After the cutting surface has been cut, the inflatable deflates so that the arm is retracted.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
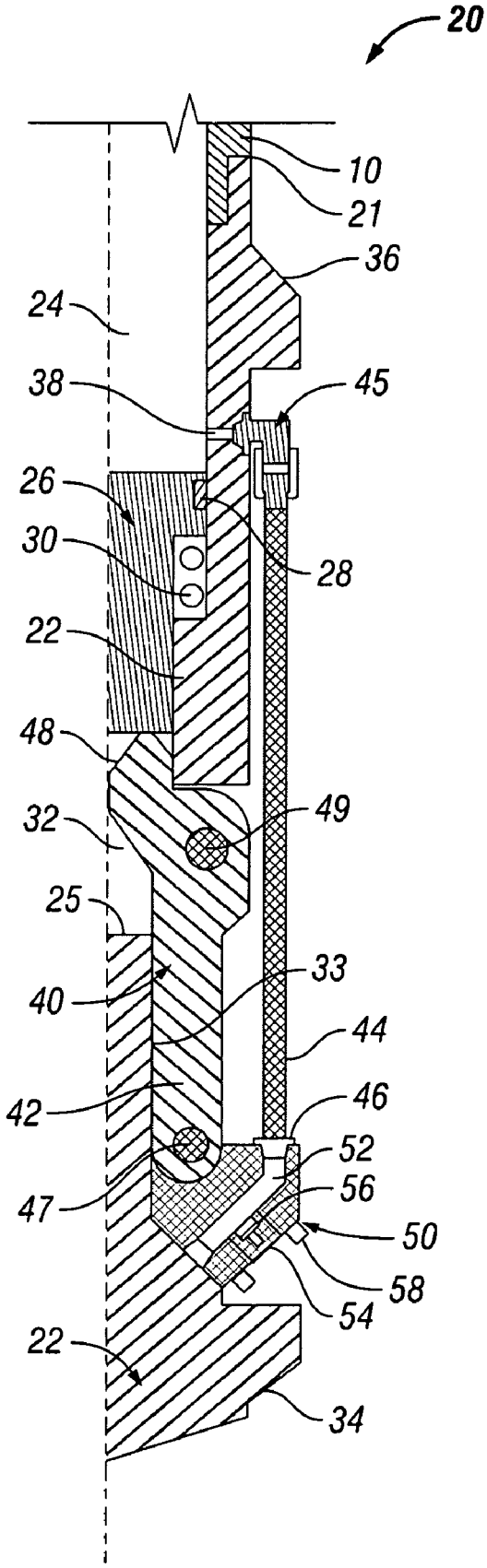
FIG. 1 is a cross-sectional view of one embodiment of the jet cutting tool of the present invention shown in its retracted or run-in position.
Figure 2:
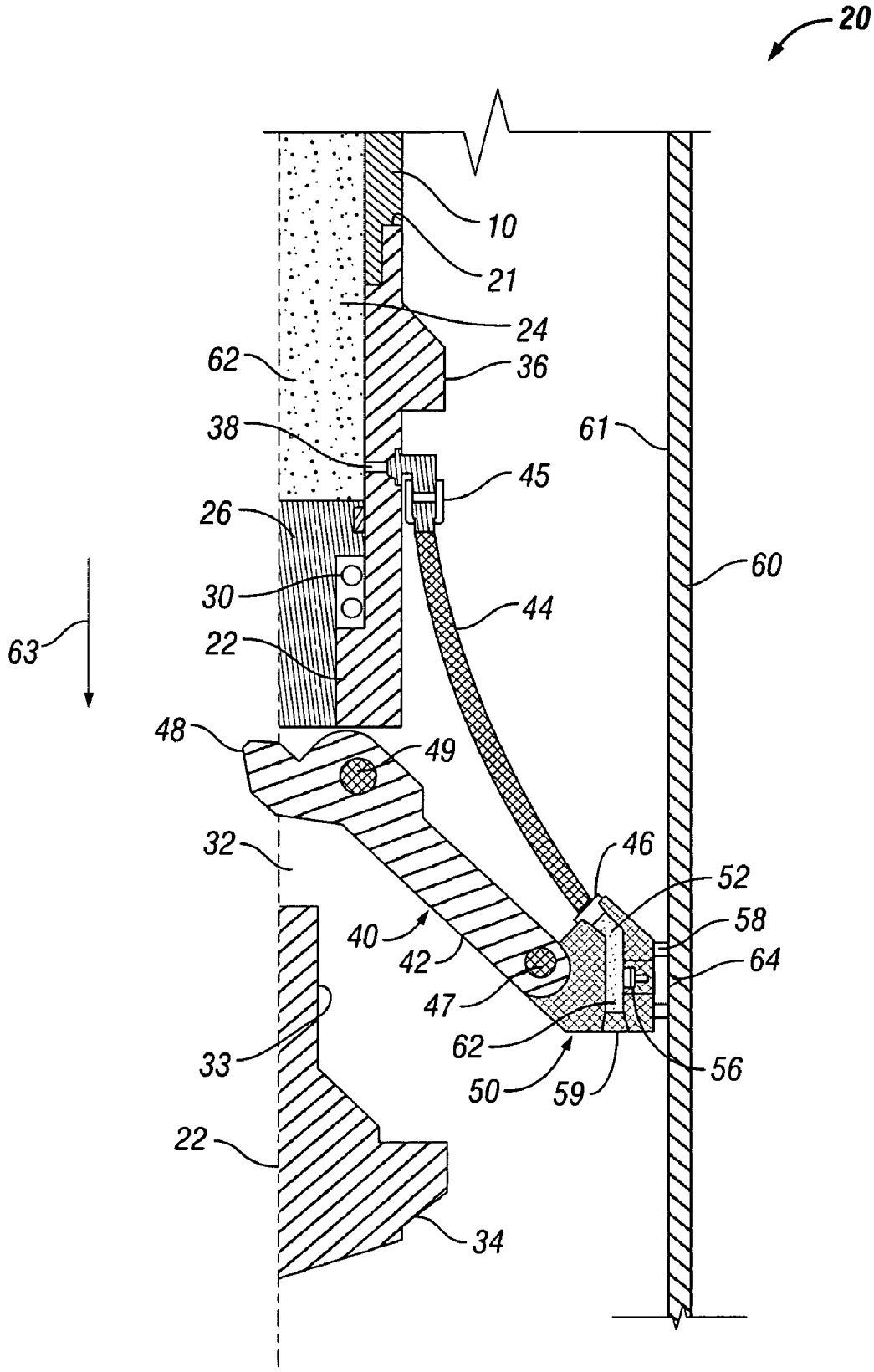
FIG. 2 is a cross-sectional view of the jet cutting tool illustrated in FIG. 1 shown in its extended or cutting position.

Referring now to FIGS. 1-2, jet cutting tool 20 is shown in its retracted or "run-in" position (FIG. 1) and an extended or cutting position (FIG. 2). Jet cutting tool 20 has housing 22 with passageway 24 extending longitudinally into upper end 21 of housing 22. Upper end 21 is adapted to be connected to string of conduit 10, such as tubing or drill pipe, through any device or method known to persons of ordinary skill in the art. The lower portion of housing 22 is solid, with passageway 24 having a bottom 25 approximately midway along the length of housing 22.

Actuating member such as piston 26 is slidingly engaged within passageway 24 of housing 22. Resilient seal 28 provides a seal with piston 26 along the wall of passageway 24. Preferably, a retaining member such as coil spring 30 is disposed adjacent piston 26 for urging piston 26 upward. As discussed in greater detail below, spring 30 is expanded when jet cutting tool 20 is in its retracted position (FIG. 1) and compressed when jet cutting tool 20 is in its extended position (FIG. 2). Therefore, spring 30 is biased for retaining piston 26 in an initial or upper position in which jet cutting tool 20 is in its retracted position.

Housing 22 also includes a plurality of rectangular openings 32 (only one shown) extending through its side wall, into which part of a jet nozzle assembly 40 is received when jet cutting tool 20 is in its retracted position. Although only one jet nozzle assembly 40 is shown, typically tool 20 has three or more jet nozzle assemblies 40. Housing 22 also has a recess 33 on its exterior into which the remaining portion of jet nozzle assembly 40 locates. Opening 32 extends from passageway 24 to recess 33 and has a shorter axial length than recess 33. The lower end of opening 32 coincides with passageway bottom 25. Housing 22 also preferably includes radially extending flanges 34, 36 at its upper and lower ends for protecting jet nozzle assembly 40 when jet cutting tool 20 is in its retracted position.

Port 38, which is located above piston 26 in housing 22, provides fluid communication from passageway 24 to jet nozzle assembly 40. Jet nozzle assembly 40 comprises arm 42, tubing 44, and cutting head 50. Preferably, tubing 44 is flexible. Tubing 44 is in fluid communication with passageway 24 and cutting head 50. Couplings 45, 46 attach tubing 44 to passageway 24 and to cutting head 50, respectively. Preferably, cutting head 50 is pivotally attached to arm 42 by a fastener such as pin 47 or any other device that is capable of attaching cutting head 50 to arm 42 and allowing cutting head 50 to rotate or pivot relative to arm 42. Accordingly, cutting head 50 can pivot about the point of connection with arm 42 to facilitate better contact with the inner wall surface 61 of casing 60 (FIG. 2).

A pivot end of arm 42 is connected to housing 22 within the upper end of recess 33 by a fastener such as pin 49 or any other device that is capable of attaching the pivot end of arm 42 to housing 22 and allowing arm 42 to rotate or pivot about pivot pin 49. A lever or cam 48 is integrally formed on the upper end of arm 42 and extends through opening 32 into passageway 24 in contact with the lower end of piston 26. Cam 48 contacts piston 26 at a point that is radially inward and upward from pivot pin 49, creating a moment arm. Downward movement of piston 26 pushes downward on cam 48, causing arm 40 to pivot outward to the position shown in FIG. 2. Preferably, flanges 34, 36 protect arm 42, cutting head 50, and tubing 44 of jet nozzle assembly 40 when arm 42 is in its retracted position (FIG. 1). As shown in FIG. 1, in a preferred embodiment, tubing 44 has little or no slack in it when jet cutting tool 20 is in the retracted position. Therefore, the risk of tubing 44 being damaged or broken when jet cutting tool 20 is being run into the well is lessened.

Cutting head 50 has passage 52 disposed therein. Passage 52 is in fluid communication with coupling 46 and, thus, tubing 44 and passageway 24. Cutting head 50 also includes opening 54 with nozzle 56. As shown in the embodiment of FIGS. 1 and 2, passage 52 in cutting head 50 includes plug 59. Plug 59 is used to close one end of passage 52 when passage 52 is formed by drilling all the way through cutting head 50. In other words, plug 59 may be included if certain methods of manufacturing cutting head 50 are utilized.

Figure 3:
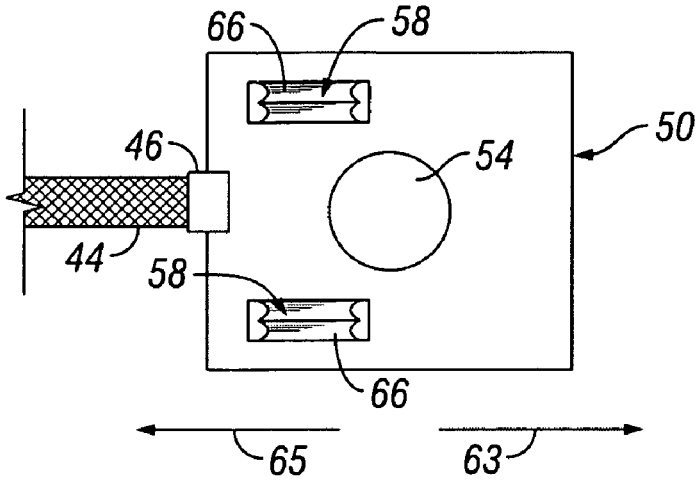
FIG. 3 is a top view of a cutting head of one specific embodiment of the jet cutting tool of the present invention.

Cutting head 50 also preferably includes one or more standoffs 58 that engage the wall surface of casing 60 (FIG. 2) and facilitate maintaining cutting head 50 and, thus, jet cutting tool 20 in place. Standoffs 58 preferably also provide guidance of cutting nozzle 56 in the same track. As shown in FIGS. 1 and 2, standoffs 58 may comprise dome buttons formed of a hard, wear resistant material such as tungsten carbide. In other embodiments, standoffs 58 are polymer elements. In still other embodiments, shown in FIGS. 3-5, standoffs 66 are bearing units such as rollers 58 having grooves 67 (shown in FIG. 5) to facilitate gripping the inner wall surface of casing 60.

Figure 4:
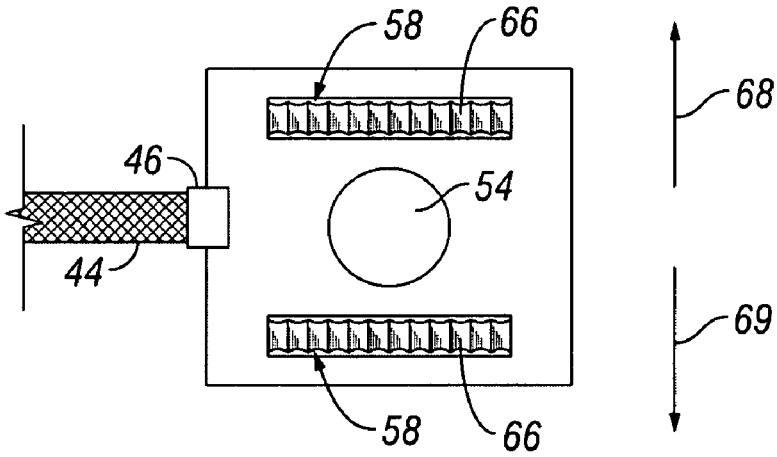
FIG. 4 is a top view of another cutting head of one specific embodiment of the jet cutting tool of the present invention.
Figure 5:
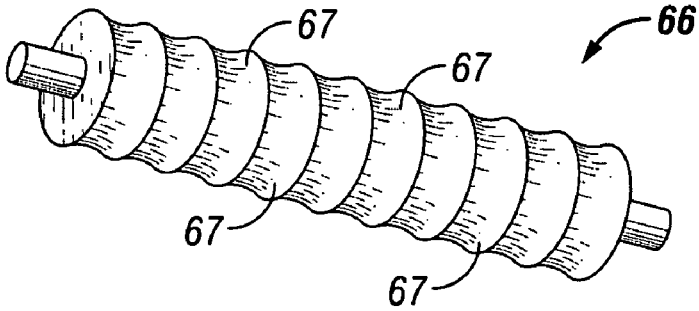
FIG. 5 is a perspective view of a roller for one embodiment of the jet cutting tools of the present invention.

Standoffs 58 may be arranged in any manner to facilitate the desired type of cut in casing 60. For example, as shown in greater detail in FIG. 3, standoffs 58 are rollers 66 for rolling axially along the inner wall surface of casing 60 (FIG. 2) in the direction of arrow 63 and arrow 65 when cutting tool 20 is making an axial cut. Alternatively, as shown in FIG. 4, rollers 66 may be rotated 90 degrees, i.e., perpendicular to rollers 66 shown in FIG. 3, such that they rotate and, thus, cut, in the direction of arrows 68 and 69 when cutting tool 20 is making a circumferential cut. In one specific embodiment, standoffs 58 are ball bearings (not shown) capable of rotating in any direction.

As mentioned above, FIG. 1 shows jet cutting tool 20 in its initial or "run-in" position. Each arm 42 is retracted and disposed along housing 22. After jet cutting tool 20 is properly placed within casing 60 of the well (not shown), cutting fluid 62 (FIG. 2) is pumped down conduit string 10 through passageway 24 of jet cutting tool 20. Cutting fluid 62 forces piston 26 to move downward, i.e., in the direction of arrow 63. In so doing, spring 30 is compressed and piston 26 pushes on cam end 48 and rotates arm 42 around or about pivot pin 49, causing arm 42 to extend outwardly from housing 22 until standoffs 58 of cutting head 50 contact the inner wall surface of casing 60 as illustrated in FIG. 2. Thus, jet cutting tool 20 is placed in its extended or cutting position.

After cutting head 50 contacts the inner wall surface of casing 60, piston 26 can no longer move in the direction of arrow 63. Therefore, cutting fluid 62 is forced at a greater pressure through tubing 44 to cutting head 50 where it is focused through passage 52 into and through nozzle 56 and out of opening 54 at a high pressure to cut the inner wall of casing 60 as illustrated by cut 64 (FIG. 2). The operator moves conduit string axially to form an axial cut and rotates conduit string 10 to form a circumferential cut. In one specific embodiment (not shown), cutting fluid 62 propels a rotatable cutting member (not shown) to facilitate cutting of the inner wall surface of casing 60. In other embodiments, all of the cutting is performed by cutting fluid 62 being expelled through nozzle 56 at a high pressure.

Cutting fluids 62, and their cutting rates, are known to persons skilled in art. Preferably, cutting fluid 62 is an abrasive cutting fluid such as those having a ratio of 1 pound of abrasive material per gallon of water carrier. Suitable abrasive materials are known in the art such as ground garnet material which is available from many known sources. The water in cutting fluid 62 can be enhanced with polymers to increase the stream holding profile of the cutting fluid 62 to increase cutting efficiency. Typical cutting rates, but by no means the only cutting rates, are expected to be approximately 1 inch per minute using the foregoing cutting fluid 62.

After casing 60 has been cut as desired by the operator of jet cutting tool 20, the operator ceases pumping cutting fluid 62 down conduit string 10. Accordingly, the force being applied to piston 26 in the direction of arrow 63 ceases. When this occurs, spring 30 expands and, thus, moves piston 26 upward in the opposite direction of arrow 63. The weight of jet nozzle assembly 40 causes arm 42 to rotate or pivot about cam end 48 until jet nozzle assembly 40 is received within recess 33 of housing 22. In other words, the removal of the pressure of cutting fluid 62 flowing through passageway 24 of jet cutting tool 20 causes jet cutting tool 20 to return to its run-in position. Subsequently, jet cutting tool 20 can be moved to a new location for additional cutting. Advantageously, the new location can have a smaller diameter and jet cutting tool 20 will properly deploy without the need for removal of jet cutting tool 20 from the well.

Figure 6:
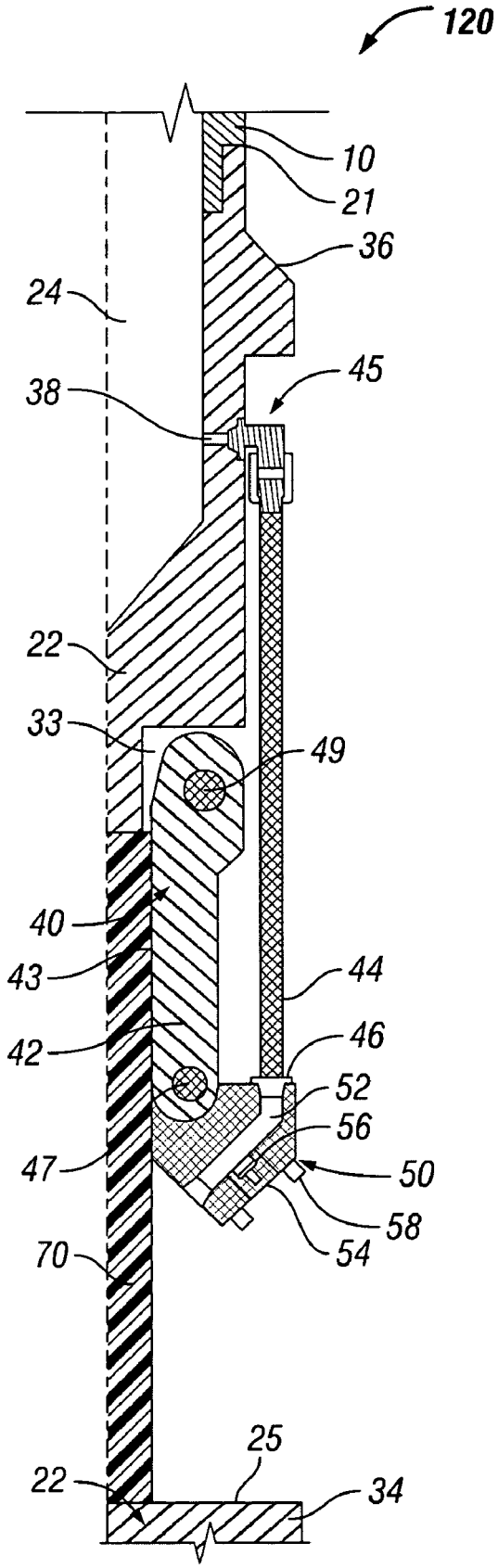
FIG. 6 is a cross-sectional view of another embodiment of the jet cutting tool of the present invention shown in its retracted or run-in position.
Figure 7:
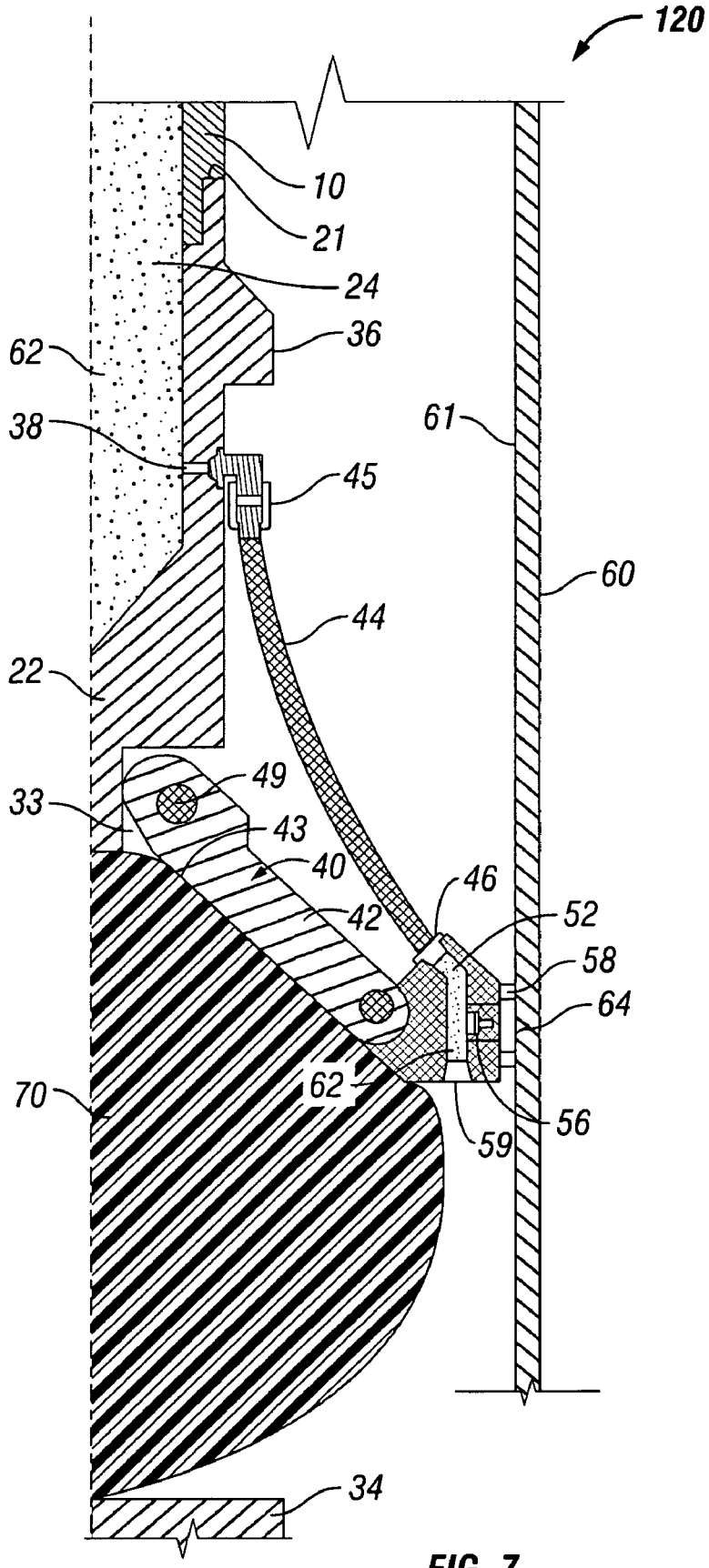
FIG. 7 is a cross-sectional view of the jet cutting tool illustrated in FIG. 6 shown in its extended or cutting position.

Referring now to FIGS. 6-7, in another embodiment, jet cutting tool 120 includes some of the same components and structures as discussed above with respect to the embodiment of FIGS. 1-2 as shown by the use of reference numerals in FIGS. 6-7 that are identical to those in FIGS. 1-2. In addition, jet cutting tool 120 includes inflatable member 70 as an actuating member for jet nozzle assembly 40. Inflatable member 70 may be any inflatable device known in the art. For example, inflatable member 70 may be a bladder formed out of an elastomeric or polymeric material and having a cavity. The cavity of inflatable member 70 can be in fluid communication with passageway 24 so that inflatable member 70 can be inflated by fluid flowing through passageway 24 and into the cavity of inflatable member 70.

In operation of the embodiment shown in FIGS. 6-7, jet cutting tool 120 is placed in its initial or "run-in" position shown in FIG. 6 so that arm 42 is retracted and disposed along housing 22. After jet cutting tool 120 is placed within casing 60 of the well (not shown), cutting fluid 62 (FIG. 7) is pumped down conduit string 10 through passageway 24 of jet cutting tool 120 and into inflatable member 70. Cutting fluid 62 causes inflatable member 70 to inflate and, thus, expand radially outward toward the inner wall surface of casing 60. In so doing, inflatable member 70 pushes on inner wall surface 43 of arm 42 and rotates arm 42 around or about pivot pin 49, causing arm 42 to extend outwardly from housing 22 until standoffs 58 of cutting head 50 contact the inner wall surface of casing 60 as illustrated in FIG. 7. Thus, jet cutting tool 120 is placed in its extended or cutting position.

After cutting head 50 contacts the inner wall surface of casing 60, inflatable member 70 can no longer expand. Therefore, cutting fluid 62 is forced at a greater pressure through tubing 44 to cutting head 50 where it is focused through passage 52 into and through nozzle 56 and out of opening 54 at a high pressure to cut the inner wall of casing 60 as illustrated by cut 64 (FIG. 7). As with the embodiment of FIGS. 1-2, the operator can then move conduit string 10 axially to form an axial cut and rotate conduit string 10 to form a circumferential cut. In one specific embodiment (not shown), cutting fluid 62 propels a rotatable cutting member (not shown) to facilitate cutting of the inner wall surface 61 of casing 60. In other embodiments, all of the cutting is performed by cutting fluid 62 being expelled through nozzle 56 at a high pressure.

After casing 60 has been cut as desired by the operator of jet cutting tool 120, the operator ceases pumping cutting fluid 62 down conduit string 10. Accordingly, the force being applied to inflatable member 70 ceases. The weight of jet nozzle assembly 40 causes arm 42 to rotate or pivot about cam end 48, forcing cutting fluid 62 out of inflatable member 70. As a result, inflatable member 70 deflates until jet nozzle assembly 40 is received within recess 33 of housing 22. In other words, the removal of the pressure of cutting fluid 62 flowing through passageway 24 of jet cutting tool 120 causes jet cutting tool 120 to return to its run-in position. Subsequently, jet cutting tool 120 can be moved to a new location for additional cutting. Advantageously, the new location can have a smaller diameter and jet cutting tool 120 will properly deploy without the need for removal of jet cutting tool 120 from the well.

Figure 8:
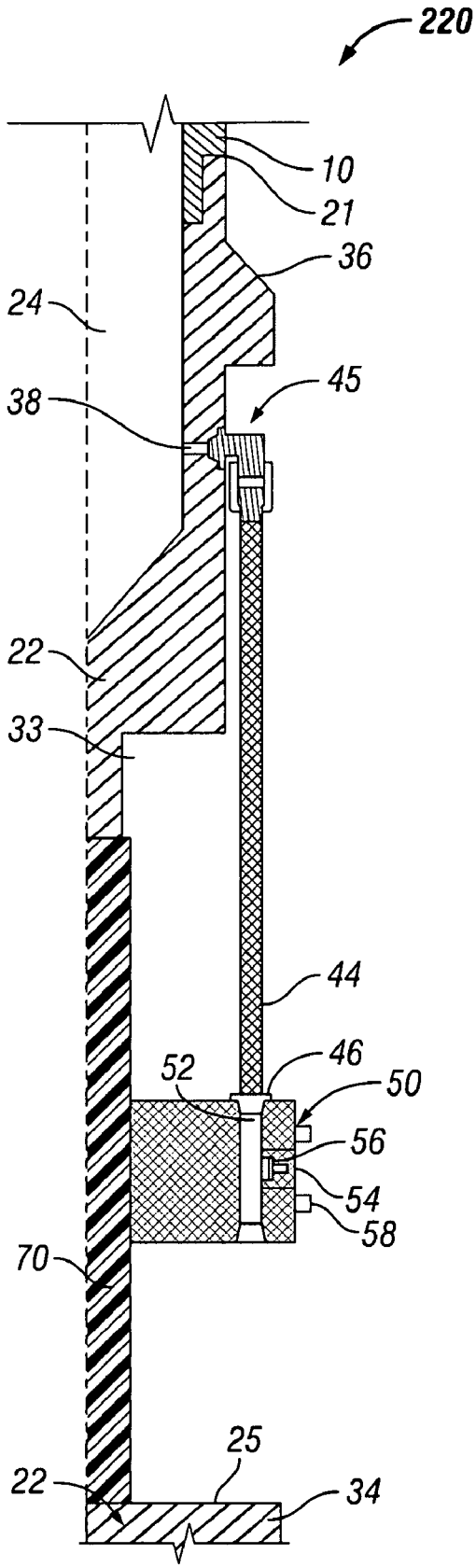
FIG. 8 is a cross-sectional view of an additional embodiment of the jet cutting tool of the present invention shown in its retracted or run-in position.
Figure 9:
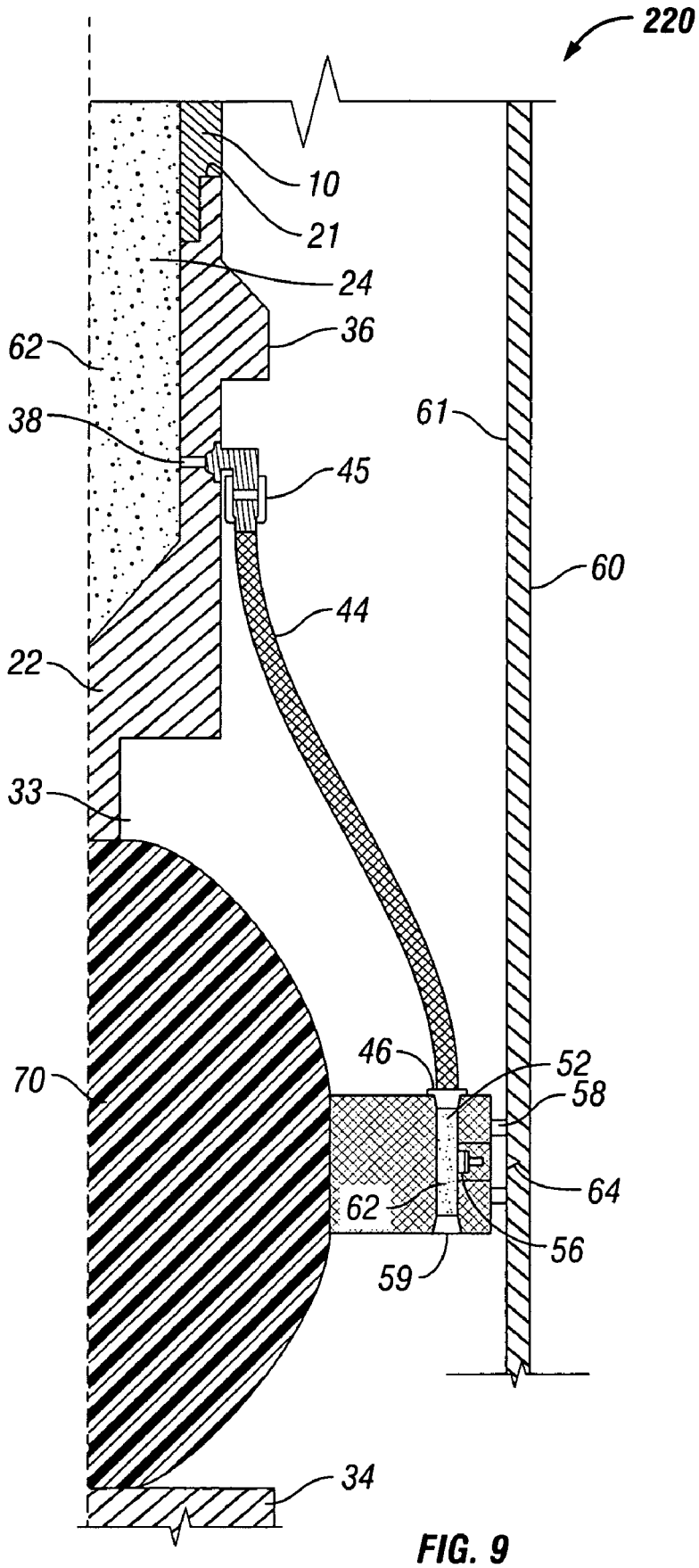
FIG. 9 is a cross-sectional view of the jet cutting tool illustrated in FIG. 8 shown in its extended or cutting position.

Referring now to FIGS. 8-9, in an additional embodiment, jet cutting tool 220 is similar to jet cutting tool 120, however, jet cutting tool 220 does not include arm 42. Instead, cutting head 50 is disposed on inflatable member 70 so that when inflatable member 70 is inflated, cutting head 50 is moved radially outward to engage the cutting surface, i.e., wall 61 of casing 60.

Figure 10:
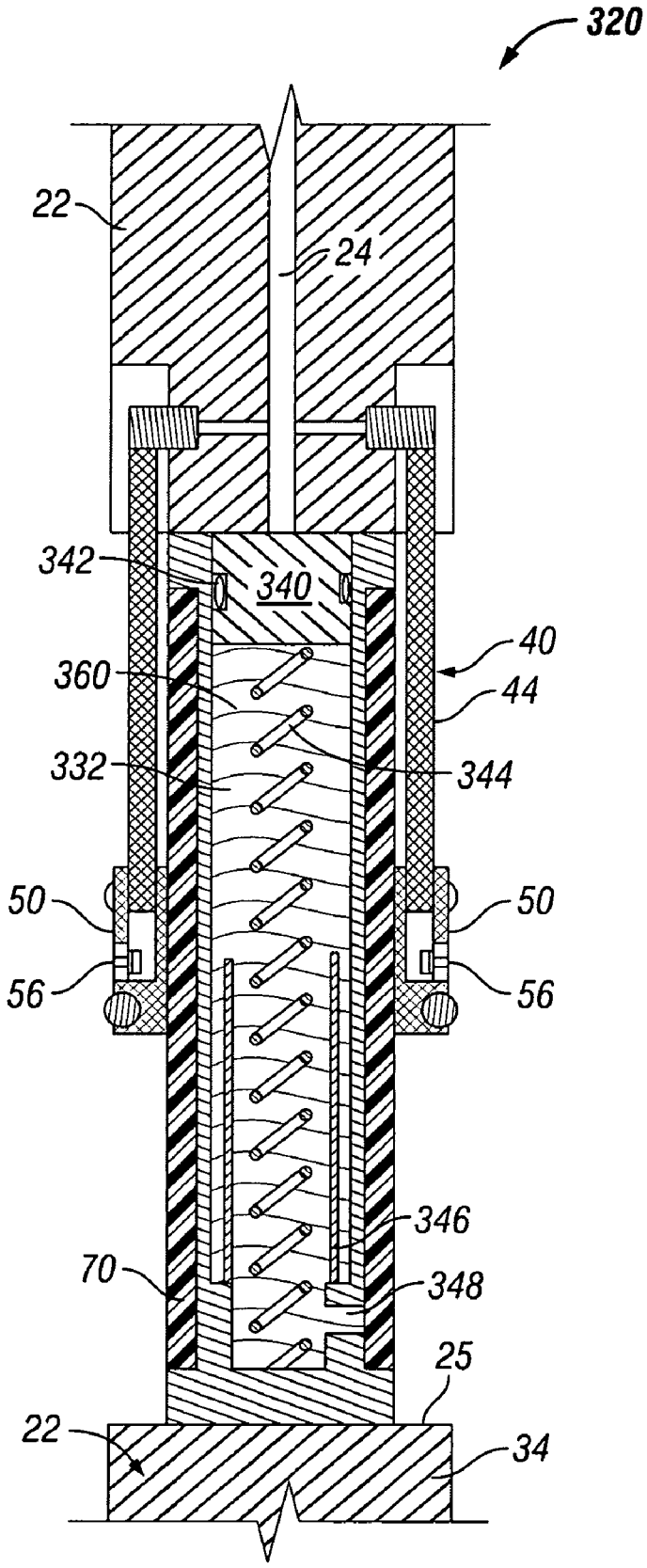
FIG. 10 is a cross-sectional view of another embodiment of the jet cutting tool of the present invention shown in its retracted or run-in position.
Figure 11:
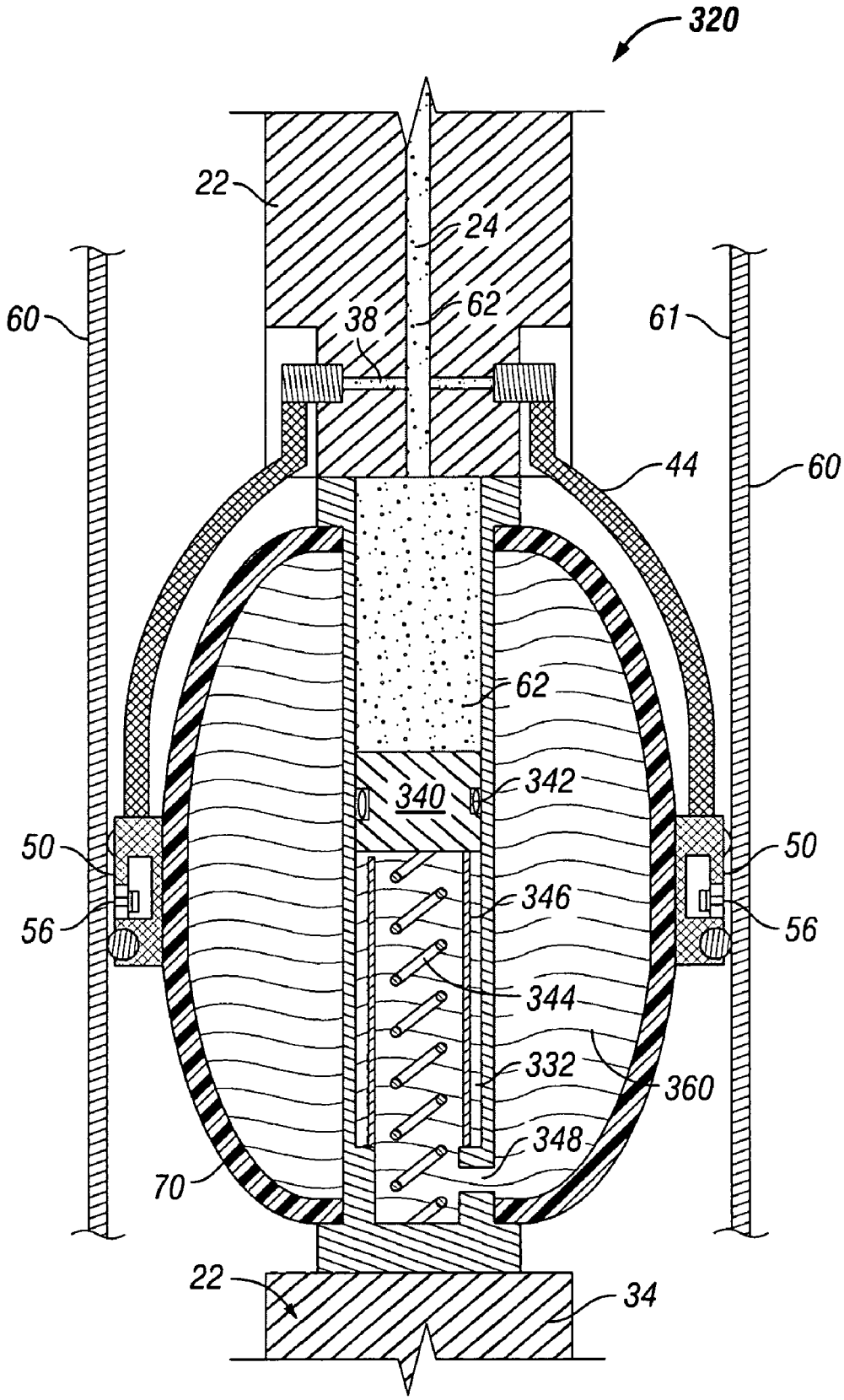
FIG. 11 is a cross-sectional view of the jet cutting tool illustrated in FIG. 10 shown in its extended or cutting position.

With respect to FIGS. 10-11, in another embodiment, jet cutting tool 320 is similar to jet cutting tool 220, however, the assembly for inflating inflatable member 70 further comprises inflation fluid chamber 332 having disposed therein an actuating member shown as piston 340. Inflation fluid chamber 332 further comprises a biased member shown as coiled spring 344 that is biased in the run-in position (FIG. 10), stop ring 346, and port 348 that places inflation fluid chamber 332 in fluid communication with the cavity or interior of inflatable member 70. Inflation fluid 360 is disposed within inflation fluid chamber below piston 340.

In the specific embodiment of FIGS. 10-11, the upper surface of piston 340 is in fluid communication with a bore of the conduit string (not shown in FIGS. 10-11) so that fluid pressure from cutting fluid 62 (FIG. 11) can be pumped downward from the wellbore surface, onto the upper surface of piston 340 and, in turn, force piston 340 downward within inflation fluid chamber 332 such as by having piston 340 in sliding engagement with an inner wall surface of inflation fluid chamber 332. Seals 342 assist in preventing leakage.

As the pressure of cutting fluid 62 acting downward on piston 340 increases, piston 340 is forced downward which, in turn, compress or energizes coiled spring 344 and also forces the inflation fluid contained within inflation fluid chamber 332 through port 348 and into inflatable member 70 so that inflatable member 70 inflates until cutting head 50 is in contact with inner wall surface 61 of casing 60 (FIG. 11). Alternatively, piston 340 is forced downward until it contacts stop ring 346 even if cutting head 50 is not in contact with inner wall surface 61 of casing 60. In either of these circumstances, the biased member is energized such that it exerts an upward force on piston 340.

After the cutting head 50 is in contact with inner wall surface 61 of casing 60, or the piston 340 is in contact with stop ring 346, cutting fluid 62 within passageway 24 is forced through port 38, tubing 44, into cutting head 50 and out nozzle 56 to cut casing 60 in the same manner as described above.

After casing 60 has been cut as desired by the operator of jet cutting tool 320, the operator ceases pumping cutting fluid 62 down the conduit string. Accordingly, the force being applied to inflatable member 70 ceases until the upward force provided by biased member, e.g., coiled spring 344, overcomes the downward pressure of cutting fluid 62 so that piston 340 is forced upward. In so doing, inflation fluid within inflatable member 70 is forced through port 348 and into inflation fluid chamber 332 so that inflation member 70 deflates. As a result, jet nozzle assembly 40 is received within recess 33 of housing 22. Subsequently, jet cutting tool 320 can be moved to a new location for additional cutting. Advantageously, the new location can have a smaller diameter and jet cutting tool 320 will properly deploy without the need for removal of jet cutting tool 320 from the well.

It is to be understood that the invention is not limited to the exact details of construction, operation, exact materials, or embodiments shown and described, as modifications and equivalents will be apparent to one skilled in the art. For example, the cutting head is shown as having a rectangular or square shape; however, cutting head can have any shape desired or necessary for providing the type of cut desired by the operator of the jet cutting tool. Likewise, the arm of the jet nozzle assembly and its corresponding recess can have any shape desired or necessary to permit extension and retraction as described above. Moreover, the tubing can be made of any material desired or necessary to facilitate transportation of the cutting fluid from the passageway to the cutting head. Additionally, the size of the opening from the passageway to the tubing, the size of the tubing, the size of the passageway in the cutting head, the size of the nozzle, and the size of the opening in the cutting head can be any size desired or necessary to provide the desired size and depth of cut in the casing. Further, the cutting surface is not limited to casing. Other types of conduits, tubings, or structures may be cut using the jet cutting tools described herein. In addition, spring can be replaced by a pressurized chamber or another device that is biased toward keeping the piston in the retracted position. Alternatively, hydrostatic pressure could provide the force for biasing the piston toward the retracted position by having the passageway in the housing continuing to the end of the jet cutting tool where it is opened to the wellbore. Moreover, the piston may be replaced with a valve or other actuating member known to persons of ordinary skill in the art. Additionally, the tubing may be inflexible and the couplings of the tubing to the housing and the cutting head may be flexible joints providing 360 degree movement. Further, a top sub may be connected to and placed in communication with the passageway of the housing and the tubing may be in fluid communication with the passageway of the housing through a port in the top sub instead of through a port in the housing. Additionally, a ported collar in fluid communication with the tubing may be secured to the exterior of the top sub to place the tubing in fluid communication with the port in the top sub and, thus, in fluid communication with the passageway. Moreover, the actuating member and the biased member of FIGS. 10-11 can be any actuating members or biased members known to persons of ordinary skill in the art. Accordingly, the invention is therefore to be limited only by the scope of the appended claims.

What is claimed is:

1. A downhole jet cutting tool comprising:

a housing having an upper end for connection to a conduit string for running the downhole jet cutting tool into a well, the housing having a passageway for communicating a cutting fluid pumping down the conduit string to the downhole jet cutting tool;

an inflatable member operatively associated with the passageway whereby the inflatable member is inflated by the cutting fluid, the inflatable member having an initial position and a plurality of inflated positions; and a jet nozzle assembly, the jet nozzle assembly comprising a cutting head having a nozzle for expelling the cutting fluid, the jet nozzle assembly being disposed on an outer wall surface of the inflatable member so that as the inflatable member moves from the initial position to the plurality of inflated positions, the jet nozzle assembly moves from a retracted position to a plurality of corresponding extended positions, wherein the passageway of the housing and the nozzle of the cutting head are in fluid communication with each other such that the cutting fluid can flow from the passageway and out of the nozzle at a pressure sufficient to cut a cutting surface disposed within the well.

2. The downhole jet cutting tool of claim 1, wherein the jet nozzle assembly further comprises an arm operatively associated with the inflatable member whereby the arm is moved from an arm retracted position to one of a plurality of arm extended positions by the inflatable member moving from the initial position to corresponding inflated positions, the arm having a cutting end and pivot end, the pivot end being pivotally connected to the housing and the cutting end comprising the cutting head.

3. The downhole jet cutting tool of claim 2, wherein the cutting head is pivotally connected to the arm and is in sliding engagement with the outer wall surface of the inflatable member.

4. The downhole jet cutting tool of claim 2, wherein the housing has an opening leading from the passageway to an exterior portion of the housing, and the arm has a portion that extends through the opening into the passageway in engagement with the inflatable member.

5. The downhole jet cutting tool of claim 1, wherein the passageway and the nozzle are in fluid communication with each other through a flexible tubing.

6. The downhole jet cutting tool of claim 5, wherein the flexible tubing is in fluid communication with the passageway through a port disposed in the housing above the inflatable member.

7. The downhole jet cutting tool of claim 1, wherein the housing includes a recess for receiving the jet nozzle assembly when the arm is in the retracted position.

8. The downhole jet cutting tool of claim 1, wherein the inflatable member is located in the passageway that is inflated by the cutting fluid flowing down the passageway and into the inflatable member.

9. The downhole jet cutting tool of claim 1, wherein the cutting head includes at least one standoff for contact with the cutting surface in the well while the arm is in one of the extended positions.

10. The downhole jet cutting tool of claim 9, wherein at least one of the at least one standoffs comprises a roller.

11. The downhole jet cutting tool of claim 10, wherein the roller has an outer surface with at least one groove disposed on the outer surface.

12. The downhole jet cutting tool of claim 1, wherein the cutting head is affixed to the outer wall surface of the inflatable member.

13. A method of cutting a surface disposed within a well, the method comprising the steps of:

(a) running a downhole jet cutting tool on a conduit string into a well to a first location, the downhole jet cutting tool having an inflatable member in an initial position and a plurality of inflated positions and a cutting head, the cutting head being movable from a retracted position by movement of the inflatable member from the initial position to at least one of the plurality of inflated positions;

(b) pumping a cutting fluid down the string to inflate the inflatable member from the initial position to at least one of the plurality of inflated positions, inflation of the inflatable member causing the cutting head to move from the retracted position outward into contact with a surface disposed in the well;

(c) continuing to pump the cutting fluid down the string which flows to and out of the cutting head, resulting in the surface being cut; and (d) after the surface has been cut, stopping the pumping of cutting fluid down the string which allows the inflatable member to move toward its initial position and, thus, causing the cutting head to return toward the retracted position.

14. The method of claim 13, wherein the inflatable member is inflated by pumping the cutting fluid into a cavity of the inflatable member.

15. The method of claim 13, further comprising:

moving the downhole jet cutting tool to a second location within the well after completion of step (d) and repeating steps (b) and (c).

16. The method of claim 15, wherein the second location is narrower than the first location.

17. A method of cutting a casing disposed within a well, the method comprising the steps of:

(a) running a downhole jet cutting tool on a conduit string into a tubular member of a well to a first location, the downhole jet cutting tool having an inflatable member in an initial position and a cutting head, the cutting head being movable from a retracted position by movement of the inflatable member from the initial position;

(b) pumping a cutting fluid down the string to inflate the inflatable member from the initial position causing the cutting head to move outward into contact with a surface of the tubular member;

(c) continuing to pump the cutting fluid down the string which flows to and out of the cutting head, resulting in the tubular member being cut; and (d) after the tubular member has been cut, stopping the pumping of cutting fluid down the string which allows the inflatable member to return toward its initial position and, thus, causing the cutting head to return toward the retracted position.

18. The method of claim 17, further comprising:

moving the downhole jet cutting tool to a second location within the well after completion of step (d) and repeating steps (b) and (c).

19. The method of claim 18, wherein the second location is narrower than the first location.

* * * * *